US009595384B2

(12) United States Patent
Nakamura et al.

(10) Patent No.: US 9,595,384 B2
(45) Date of Patent: Mar. 14, 2017

(54) COIL SUBSTRATE, METHOD FOR MANUFACTURING COIL SUBSTRATE, AND INDUCTOR

(71) Applicant: SHINKO ELECTRIC INDUSTRIES CO., LTD., Nagano (JP)

(72) Inventors: Atsushi Nakamura, Nagano (JP); Tsukasa Nakanishi, Nagano (JP); Yoichi Sasada, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 25 days.

(21) Appl. No.: 14/338,483

(22) Filed: Jul. 23, 2014

(65) Prior Publication Data

US 2015/0035634 A1 Feb. 5, 2015

(30) Foreign Application Priority Data

Jul. 31, 2013 (JP) ..... 2013-159571

(51) Int. Cl.
*H01F 5/00* (2006.01)
*H01F 41/04* (2006.01)
*H01F 17/00* (2006.01)

(52) U.S. Cl.
CPC ..... *H01F 41/046* (2013.01); *H01F 5/00* (2013.01); *H01F 17/0013* (2013.01); *H01F 2017/0066* (2013.01); *Y10T 29/49071* (2015.01)

(58) Field of Classification Search
CPC ..... H01F 5/00; H01F 27/00–27/30
USPC ..... 336/65, 200, 232
See application file for complete search history.

(56) References Cited

U.S. PATENT DOCUMENTS

2007/0290782 A1* 12/2007 Yokoyama ..... H01F 27/2804 336/200
2008/0143468 A1* 6/2008 Yokoyama ..... H01F 1/342 336/200
2008/0169896 A1* 7/2008 Edo ..... H01F 17/0033 336/200
2008/0179963 A1* 7/2008 Fouquet ..... H01F 19/08 307/104
2013/0222101 A1* 8/2013 Ito ..... H01F 17/04 336/83
2015/0028984 A1* 1/2015 Kang ..... H01F 17/0006 336/192
2015/0116950 A1* 4/2015 Yoo ..... H05K 1/116 361/728
2015/0270055 A1* 9/2015 Nakamura ..... H01F 5/00 336/200

FOREIGN PATENT DOCUMENTS

JP 2003-168610 6/2003

* cited by examiner

*Primary Examiner* — Tuyen Nguyen
(74) *Attorney, Agent, or Firm* — IPUSA, PLLC

(57) ABSTRACT

A coil substrate includes a substrate, a coil-shaped wiring provided on one surface of the substrate, the coil-shaped wiring including adjacent parts provided adjacent to each other, and an insulating layer formed between the adjacent parts of the coil-shaped wiring. The coil-shaped wiring includes a first wiring, and a second wiring that is layered on the first wiring and has a thickness greater than a thickness of the first wiring. A space is provided between a side surface of the first wiring and the insulating layer. The second wiring fills the space and covers the first wiring. Both side surfaces of the second wiring contact the insulating layer.

9 Claims, 8 Drawing Sheets

COIL SUBSTRATE, METHOD FOR MANUFACTURING COIL SUBSTRATE, AND INDUCTOR

CROSS-REFERENCE TO RELATED APPLICATIONS

This application is based upon and claims the benefit of priority of the prior Japanese Patent Application No. 2013-159571 filed on Jul. 31, 2013, the entire contents of which are incorporated herein by reference.

FIELD

The embodiments discussed herein are related to a coil substrate, a method for manufacturing the coil substrate, and an inductor including the coil substrate.

BACKGROUND

In recent years, the rate of size-reduction of electronic devices such as game devices and smartphones has been increasing. Along with the increasing rate of size-reduction, there is also a demand for size-reduction of various devices (e.g., inductor) mounted on the electronic devices. One known example of the inductor mounted on the electronic device is an inductor that uses a winding coil. The inductor using the winding coil is used in, for example, a power supply circuit of an electronic circuit (see, for example, Japanese Laid-Open Patent Publication No. 2003-168610).

However, a plan-view size of approximately 1.6 mm×0.8 mm is considered to be the limit in which the inductor using the winding coil can be reduced. The reason for this limit is due to the limit of the thickness of the winding coil. That is, if the plan-view size of the inductor is reduced beyond approximately 1.6 mm×0.8 mm, the proportion of the volume of the winding coil with respect to the total volume of the inductor would be reduced. Thus, inductance cannot be increased.

SUMMARY

According to an aspect of the invention, there is provided a coil substrate including a substrate, a coil-shaped wiring provided on one surface of the substrate, the coil-shaped wiring including adjacent parts provided adjacent to each other, and an insulating layer formed between the adjacent parts of the coil-shaped wiring. The coil-shaped wiring includes a first wiring, and a second wiring that is layered on the first wiring and has a thickness greater than a thickness of the first wiring. A space is provided between a side surface of the first wiring and the insulating layer. The second wiring fills the space and covers the first wiring. Both side surfaces of the second wiring contact the insulating layer.

The object and advantages of the invention will be realized and attained by means of the elements and combinations particularly pointed out in the claims.

It is to be understood that both the foregoing general description and the followed detailed description are exemplary and explanatory and are not restrictive of the invention as claimed.

DESCRIPTION OF EMBODIMENTS

Figure 1A:
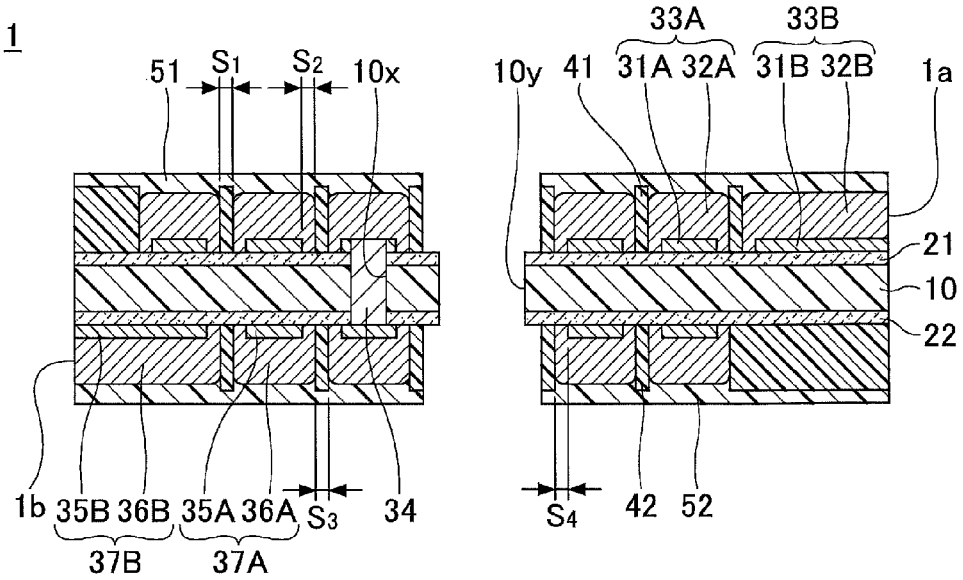
FIGS. 1A-1B are schematic diagrams illustrating a coil substrate according to an embodiment of the present invention.

Next, embodiments of the present invention are described with reference to the accompanying drawings. Throughout the drawings, like components/parts are denoted with like reference numerals. Thus, detailed descriptions of like components/parts denoted with like reference numerals are omitted.

<Structure of Coil Substrate>

Figure 1B:
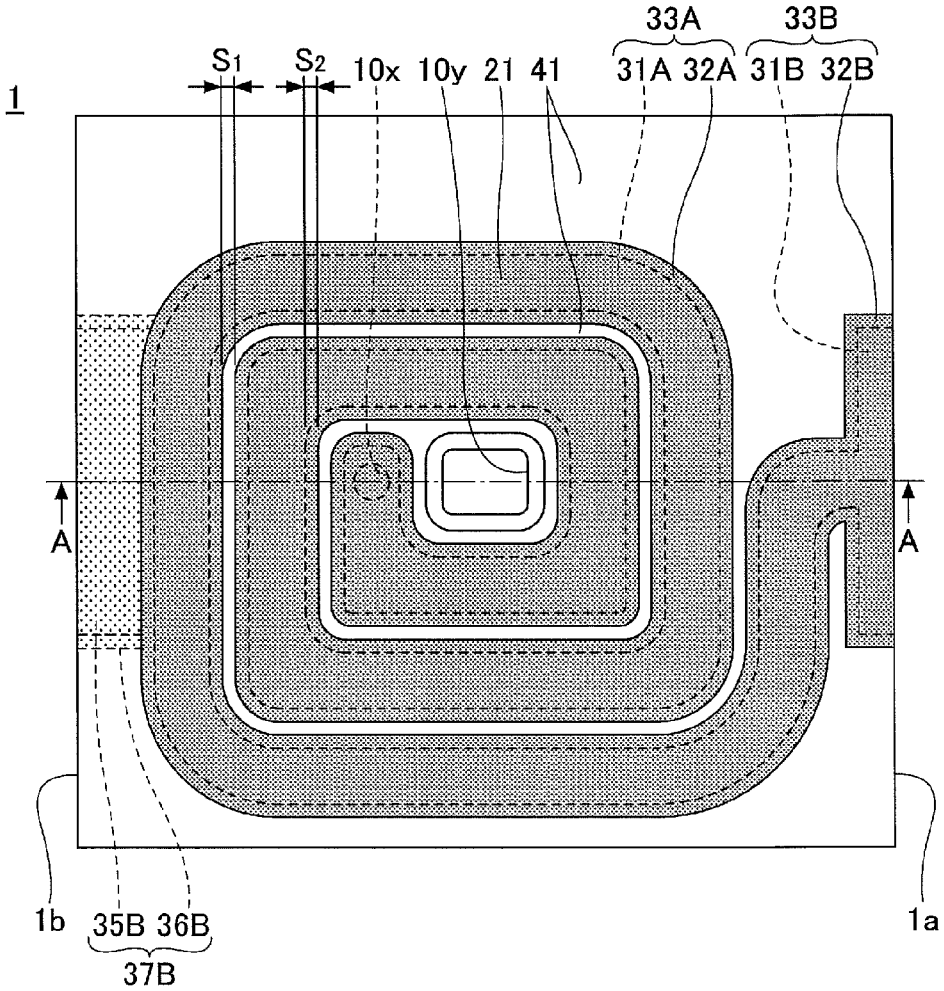

First, a structure of a coil substrate according to an embodiment of the present invention is described. FIGS. 1A and 1B are schematic diagrams illustrating a coil substrate 1 according to an embodiment of the present invention. It is to be noted that FIG. 1B is a plan view of the coil substrate 1, and FIG. 1A is a cross-sectional view of the coil substrate 1 taken along line A-A of FIG. 1B.

With reference to FIGS. 1A and 1B, the coil substrate 1 includes, for example, a substrate 10, an adhesive layer 21, an adhesive layer 22, a wiring 33A, a connection part 33B, a through-electrode 34, a wiring 37A, a connection part 37B, a permanent resist 41, a permanent resist 42, a protection layer 51, and a protection layer 52. It is, however, to be noted that the protection layer 51 is omitted from FIG. 1B.

In this embodiment, for the sake of convenience, the side positioned toward the protection layer 51 (upper side of FIG. 1A) may be described as "one side" or "upper side" whereas the side positioned toward the protection layer 52 (lower side of FIG. 1A) may be described as "other side", "another side" or "lower side". Further, a surface positioned toward a side of the protection layer 51 may be described as "one surface" or "upper surface" whereas a surface positioned toward the protection layer 52 may be described as "other surface", "another surface" or "lower surface". Further, a "plan view" refers to observing an object from a direction of a line normal to one surface of the substrate 10. Further, a "plan-view shape" of an object refers to a shape of the object observed from a direction of a line normal to one surface of the substrate 10.

The plan-view shape of the coil substrate 1 may be a rectangular shape having a size of, for example, approximately 1.6 mm×0.8 mm. The thickness of the coil substrate 1 may be, for example, approximately 0.5 mm. For example, an insulating resin film having an elastic property may be used as the substrate 10 of the coil substrate 1. For example, polyimide, polyethylene naphthalate, or polyphenylene sulfide may be used as the insulating resin. The thickness of the substrate 10 may be, for example, approximately 25 μm to 75 μm. Through-holes 10*x*, 10*y* are formed in the substrate 10.

The adhesive layer 21 is laminated on one surface of the substrate 10, so that the wiring 33A and the connection part 33B are adhered to the substrate 10. The adhesive layer 22 is laminated on the other surface of the substrate 10, so that the wiring 37A and the connection part 37B are adhered to the substrate 10. For example, a heat resistant adhesive agent formed of an insulating resin such as an epoxy type adhesive agent or a polyimide type adhesive agent may be used to form the adhesive layers 21, 22. The thickness of each the adhesive layers 21, 22 may be, for example, approximately 8 μm to 15 μm.

The wiring 33A includes a first wiring 31A and a second wiring 32A. The wiring 33A is patterned into a coil-like shape having a predetermined space(s) $S_1$ provided between the coils of the coil-shaped wiring 33A. The first wiring 31A is a single consecutive base wiring that is formed on one surface of the adhesive layer 21. For example, copper (Cu) may be used as the material of the first wiring 31A. The cross section of the first wiring 31A with respect to its transverse direction (width direction) has a substantially rectangular shape. A space $S_2$ is formed between a side surface of the first wiring 31A and a side surface of the permanent resist 41. In this embodiment, a direction extending along the coil of the wiring 33A is referred to as "longitudinal direction", and a direction that is orthogonal to the longitudinal direction is referred to as "transverse direction (horizontal direction)". The thickness of the first wiring 31A may be, for example, approximately 5 μm to 25 μm. The width of the first wiring 31A may be, for example, 15 μm to 25 μm. The width of the space $S_2$ may be, for example, approximately 5 μm.

The second wiring 32A is layered on the first wiring 31A. More specifically, the second wiring 32A is formed on one surface of the adhesive layer 21 to cover one surface of the first wiring 31A and a side surface of the first wiring 31A. That is, the first wiring 31A is covered by the second wiring 32A by filling the space $S_2$ with a material of the second wiring 32A. Thus, both side surfaces of the second wiring 32A contact the side surfaces of the permanent resist 41. The material of the second wiring 32A may be, for example, copper (Cu). The cross section of the second wiring 32A (including the cross section of the first wiring 31A) with respect to its transverse direction (width direction) has a substantially rectangular shape. That is, a cross-sectional shape of the wiring 33A is a substantially rectangular shape. The side surface of the second wiring 32A and the side surface of the permanent resist 41 contact each other. The second wiring 32A is formed thicker than the first wiring 31A. For example, the thickness of the second wiring 32A formed on the first wiring 31A (i.e. thickness of the second wiring 32A without including the first wiring 31A) may be, for example, approximately 50 μm to 200 μm. The width of the second wiring 32A (width of the wiring 33A) may be, for example, approximately 20 μm to 50 μm.

The connection part 33B is formed on one end of the wiring 33A. The connection part 33B includes a first wiring 31B and a second wiring 32B. The first wiring 31B of the connection part 33B is formed on one end of the first wiring 31A of the wiring 33A. The second wiring 32B of the connection part 33B is formed on one end of the second wiring 32A of the wiring 33A. The connection part 33B is a part to be connected with an electrode of an inductor. For the sake of convenience, different reference numerals are used to indicate the first wiring 31B and the first wiring 31A. It is, however, to be noted that the first wiring 31A and the first wiring 31B are both formed in the same step, and are integrally formed. Similarly, for the sake of convenience, different reference numerals are used to indicate the second wiring 32B and the second wiring 32A. It is, however, to be noted that the second wiring 32A and the second wiring 32B are both formed in the same step, and are integrally formed.

In one side surface 1*a* of the coil substrate 1, a side surface of the first wiring 31B is exposed from the second wiring 32B. That is, the side surface of the first wiring 31B and the side surface of the second wiring 32B are exposed from one side surface of the coil substrate 1. The exposed side surfaces of the first and second wirings 31B, 32B are parts to be connected to electrodes of the inductor.

The permanent resist 41 is an insulating layer that is formed in the space $S_1$ of the wiring 33A (i.e. provided between adjacent wirings 33A). Further, the permanent resist 41 is also formed in an outer part of the wiring 33A that is patterned into a coil shape and in an outer part of the connection part 33B (except for a part exposed from one side surface 1*a* of the coil substrate 1). The permanent resist 41 has a height that is substantially equal to or greater than the thickness of the wiring 33A. The width of the permanent resist 41 provided between adjacent parts of the wirings 33A (=width of space $S_1$) may be, for example, approximately 5 μm to 20 μm. For example, an epoxy type resin may be used as the material of the permanent resist 41. Although the permanent resist 41 is illustrated as a single insulating layer in FIG. 1A, the permanent resist 41 may be formed of multiple insulating layers.

The protection layer 51 is formed on the wiring 33A, the connection part 333, and one side of the permanent resist 41. The protection layer 51 is a layer for preventing the wiring 33A and the connection part 33B from shorting with a magnetic material included in a molding resin in a case of forming an inductor by encapsulating the coil substrate 1 in the molding resin. For example, an insulating material such as an epoxy type resin or an acrylic type resin may be used as the material of the protection layer 51. The thickness of the protection layer 51 is, for example, approximately 5 μm to 20 μm.

The wiring 37A includes a third wiring 35A and a fourth wiring 36A. The wiring 37A is patterned into a coil-like shape having a predetermined space(s) $S_3$ provided between the coils of the coil-shaped wiring 37A. The third wiring 35A is a single consecutive base wiring that is formed on another surface of the adhesive layer 22. For example, copper (Cu) may be used as the material of the third wiring 35A. The cross section of the third wiring 35A with respect to its transverse direction has a substantially rectangular shape. A space $S_4$ is formed between a side surface of the third wiring 35A and a side surface of the permanent resist 42. The thickness of the third wiring 35A may be, for example, approximately 5 μm to 25 μm. The width of the third wiring 35A may be, for example, 15 μm to 25 μm. The width of the space $S_4$ may be, for example, approximately 5 μm.

The fourth wiring 36A is layered on the third wiring 35A. More specifically, the fourth wiring 36A is formed on the other surface of the adhesive layer 22 to cover the other surface of the third wiring 35A and a side surface of the third wiring 35A. That is, the third wiring 35A is covered by the fourth wiring 36A by filling the space $S_4$ with a material of the fourth wiring 36A. Thus, both side surfaces of the fourth wiring 36A contact the side surfaces of the permanent resist 42. The material of the fourth wiring 36A may be, for example, copper (Cu). The cross section of the fourth wiring 36A (including the cross section of the third wiring 35A) with respect to its transverse direction (width direction) has a substantially rectangular shape. That is, a cross-sectional shape of the wiring 37A is a substantially rectangular shape. The side surface of the fourth wiring 36A and the side surface of the permanent resist 42 contact each other. The fourth wiring 36A is formed thicker than the third wiring 35A. For example, the thickness of the fourth wiring 36A formed on the third wiring 35A (i.e. thickness of the fourth wiring 36A without including the third wiring 35A) may be, for example, approximately 50 μm to 200 μm. The width of the fourth wiring 36A (width of the wiring 37A) may be, for example, approximately 20 μm to 50 μm.

The connection part 37B is formed on one end of the wiring 37A. The connection part 37B includes a third wiring 35B and a fourth wiring 36B. The third wiring 35B of the connection part 37B is formed on one end of the third wiring 35A of the wiring 37A. The fourth wiring 36B of the connection part 37B is formed on one end of the fourth wiring 36A of the wiring 37A. The connection part 37B is a part to be connected with an electrode of an inductor. For the sake of convenience, different reference numerals are used to indicate the third wiring 35B and the third wiring 35A. It is, however, to be noted that the third wiring 35A and the third wiring 35B are both formed in the same step, and are integrally formed. Similarly, for the sake of convenience, different reference numerals are used to indicate the fourth wiring 36B and the fourth wiring 36A. It is, however, to be noted that the fourth wiring 36A and the fourth wiring 36B are both formed in the same step, and are integrally formed.

In another side surface 1*b* of the coil substrate 1, a side surface of the third wiring 35B is exposed from the fourth wiring 36B. That is, the side surface of the third wiring 35B and the side surface of the fourth wiring 36B are exposed from another side surface of the coil substrate 1. The exposed side surfaces of the third and fourth wirings 35B, 36B are parts to be connected to electrodes of the inductor. It is to be noted that the other side surface 1*b* is a side surface that faces the one side surface 1*a*.

The permanent resist 42 is an insulating layer that is formed in the space $S_3$ of the wiring 37A (i.e. provided between adjacent wirings 37A). Further, the permanent resist 42 is also formed in an outer part of the wiring 37A that is patterned into a coil shape and in an outer part of the connection part 37B (except for a part exposed from the other side surface 1*b* of the coil substrate 1). The permanent resist 42 has a height that is substantially equal to or greater than the thickness of the wiring 37A. The width of the permanent resist 42 provided between adjacent parts of the wirings 37A (=width of space $S_3$) may be, for example, approximately 5 μm to 20 μm. For example, an epoxy type resin may be used as the material of the permanent resist 42. Although the permanent resist 42 is illustrated as a single insulating layer in FIG. 1A, the permanent resist 42 may be formed of multiple insulating layers.

The protection layer 52 is formed on the wiring 37A, the connection part 37B, and another side of the permanent resist 42. The protection layer 52 is a layer for preventing the wiring 37A and the connection part 37B from shorting with a magnetic material included in a molding resin in a case of forming an inductor by encapsulating the coil substrate 1 in the molding resin. For example, an insulating material such as an epoxy type resin or an acrylic type resin may be used as the material of the protection layer 52. The thickness of the protection layer 52 is, for example, approximately 5 μm to 20 μm.

Figure 2:
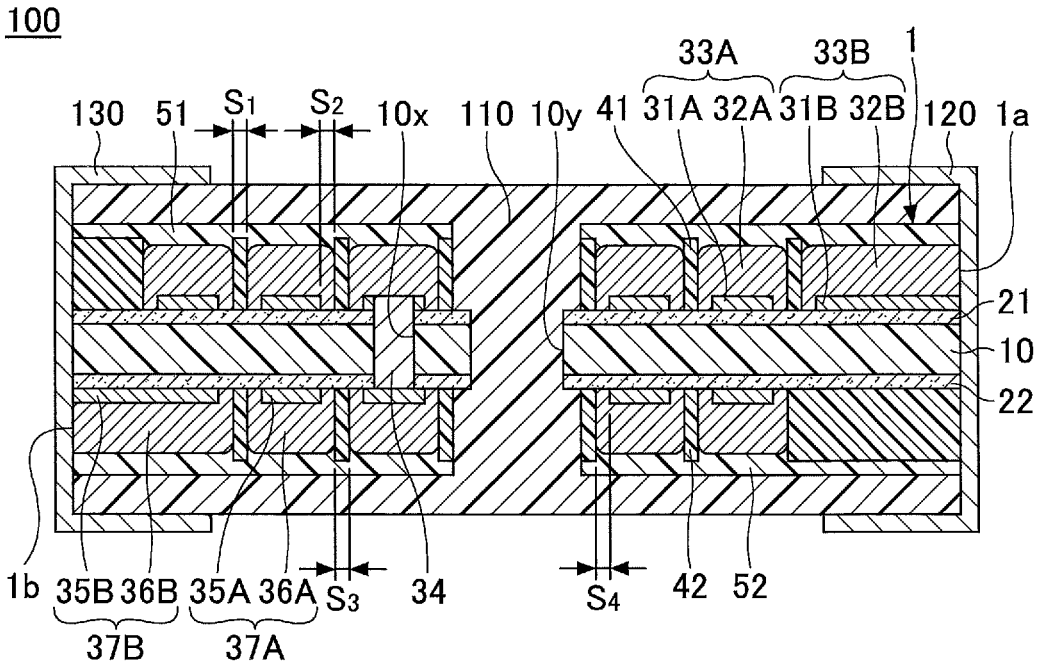
FIG. 2 is a cross-sectional view illustrating an inductor according to an embodiment of the present invention.

FIG. 2 is a cross-sectional view illustrating an inductor 100 according to an embodiment of the present invention. With reference to FIG. 2, the inductor 100 is a chip-in inductor that is formed by encapsulating the coil substrate 1 with an encapsulating resin 110 and forming electrodes 120, 130 thereon. The plan-view shape of the inductor 100 is a substantially rectangular shape having a size of, approximately 1.6 mm×0.8 mm. The thickness of the inductor 100 is, for example, approximately 1.0 mm. The inductor 100 may be used for, for example, a voltage conversion circuit of a small-sized electronic device.

In the inductor 100, the encapsulating resin 110 encapsulates the coil substrate 1 except for the one and the other side surfaces 1*a*, 1*b* of the coil substrate 1. That is, the encapsulating resin 110 covers the coil substrate 1 except for a part of the connection part 33B and a part of the connection part 37B. It is to be noted that the encapsulating resin 110 is also formed inside the through-hole 10*y*. For example, a molding resin including a filler of a magnetic material (e.g., ferrite) may be used as the encapsulating resin 110. The magnetic material included in the molding resin has a function of increasing the inductance of the inductor 100. It is to be noted that inductance can be improved because the through-hole 10*y* is formed in the coil substrate 1, and the molding resin including the magnetic material is filled in the through-hole 10*y*. Further, a core of a magnetic material such as ferrite may be provided inside the through-hole 10*y*, so that the encapsulating resin 110 including the core can be formed. The shape of the core may be, for example, a circular column shape or a rectangular parallelepiped shape.

The electrode 120, which is formed on an outer side of the encapsulating resin 110, is electrically connected to a part of the connection part 33B. More specifically, the electrode 120 is continuously formed on the one side surface of the encapsulating resin 110, a part of the upper surface of the encapsulating resin 110, and apart of the lower surface of the encapsulating resin 110. An inner sidewall of the electrode 120 contacts the side surface of the connection part 33B (i.e. side surface of the first wiring 31B and side surface of second wiring 32B) exposed from the one side surface 1*a* of the coil substrate 1. Thus, the electrode 120 and the connection part 33B are electrically connected.

The electrode 130, which is formed on an outer side of the encapsulating resin 110, is electrically connected to a part of the connection part 37B. More specifically, the electrode 130 is continuously formed on the other side surface of the encapsulating resin 110, a part of the upper surface of the encapsulating resin 110, and a part of the lower surface of the encapsulating resin 110. An inner sidewall of the electrode 130 contacts the side surface of the connection part 37B (i.e. side surface of the third wiring 35B and side surface of fourth wiring 36B) exposed from the other side surface 1*b* of the coil substrate 1. Thus, the electrode 130 and the connection part 37B are electrically connected. For example, copper (Cu) may be used as the material of the electrodes 120, 130. The electrodes 120, 130 may be formed by using various methods such as applying a copper paste, sputtering copper, or performing an electroless plating method. It is to be noted that the electrodes 120, 130 may be formed of multiple metal layers.

<Method for Manufacturing Coil Substrate>

Next, a method for manufacturing a coil substrate according to an embodiment of the present invention is described. FIGS. 3-7 are schematic diagrams illustrating processes for manufacturing a coil substrate according to an embodiment of the present invention. FIGS. 4-6 correspond to a cross-sectional view of FIG. 3B, and FIG. 7 corresponds to a plan view of FIG. 3A.

Figure 3A:
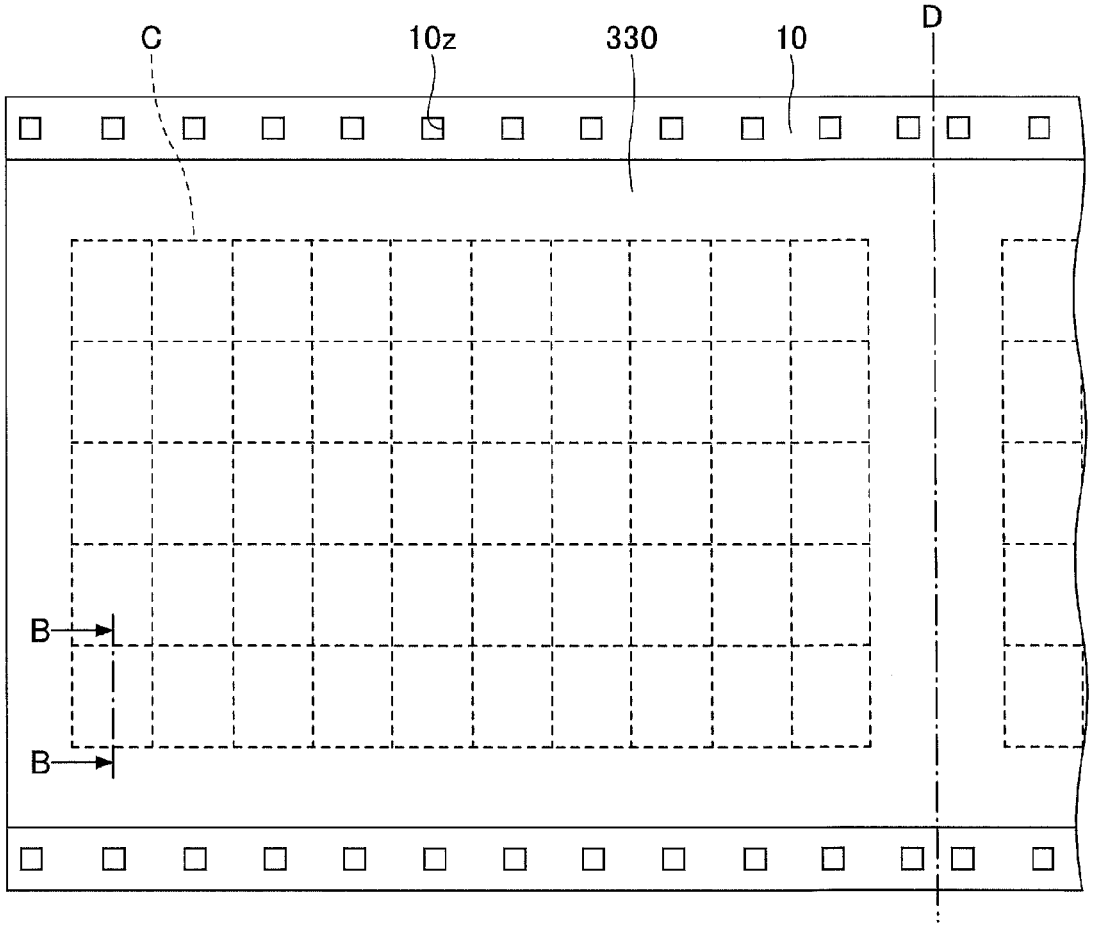
FIGS. 3A-3B are schematic diagrams illustrating processes for manufacturing a coil substrate according to an embodiment of the present invention (part 1)
Figure 3B:
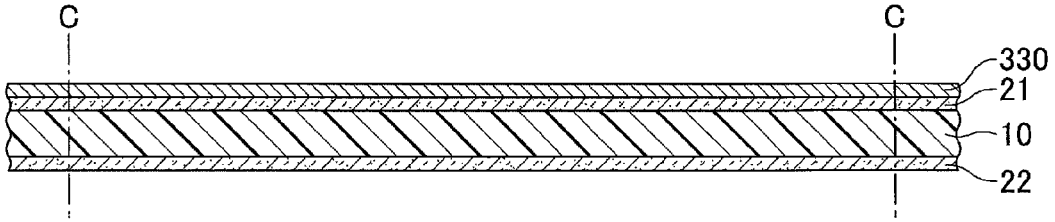

First, in the process illustrated in FIGS. 3A and 3B (FIG. 3B is a cross-sectional view, FIG. 3A is a plan view), a flexible insulating resin film is prepared. The flexible insulating resin film may have, for example, a tape-like shape that is wound around a reel. Further, multiple sprocket holes 10*z* are formed on both ends of the substrate 10 (vertical direction in FIG. 3A). The sprocket holes 10*z* are successively arranged in a longitudinal direction at substantially equal intervals. Then, at an area of the substrate 10 other than the both ends of the substrate 10 where the sprocket holes 10*z* are formed, the adhesive layer 21 and a metal foil 330 are layered on the one surface of the substrate 10, and the adhesive layer 22 is layered on the other surface of the substrate 10. In this process of forming the layers, the adhesive layers 21,22 are not cured.

Multiple areas C (hereinafter also referred to as "multiple individual areas C", which are illustrated with dotted lines in FIG. 3A, are provided within an area where the sprocket holes 10*z* are arranged on both ends of the substrate 10. The individual areas C are cut into individual pieces along the dotted lines. FIG. 3B is a cross-sectional view taken along line B-B of FIG. 3A for illustrating the vicinity of each multiple individual area. The multiple individual areas C are vertically and horizontally arranged. In this case, the multiple individual areas C may be arranged contacting each other as illustrated in FIG. 3A. Alternatively, the multiple individual areas C may be arranged at predetermined intervals. Further, the number of the individual areas C or the number of sprocket holes 10*z* may be arbitrarily determined. It is to be noted that "D" indicates a cutting area for cutting the substrate 10 in a subsequent step, so that the substrate 10 (being in the form of a tape or a reel of tape) is cut into individual sheets.

For example, a polyimide film, a polyethylene naphthalate film, or a poly phenylene sulfide film may be used the substrate 10. The thickness of the substrate 10 may be, for example, approximately 25 μm to 75 μm. For example, an adhesive agent having a thermosetting property may be used as the adhesive layers 21, 22. The adhesive agent may be formed of a heat resistant insulating resin such as an epoxy type adhesive agent or a polyimide type adhesive agent. The thickness of each of the adhesive layers 21, 22 may be, for example, approximately 8 μm to 15 μm. The metal foil 330 corresponds to the parts that eventually become the first wirings 31A, 31B. The metal foil 330 may be, for example, a copper foil. The thickness of the metal foil 330 may be, for example, approximately 5 μm to 25 μm.

In a case of mounting the substrate 10 on various manufacturing apparatuses during a process of manufacturing the coil substrate 1, the sprocket holes 10*z* are used as through-holes that mesh with corresponding pins of a sprocket driven by a motor or the like, so that the substrate 10 can be pitch-fed. The width of the substrate 10 (direction orthogonal to the direction in which the sprocket holes 10*z* are arranged) is determined according to the mounting apparatus on which the substrate 10 is mounted. The width of the substrate 10 may be, for example, approximately 40 mm to 90 mm. On the other hand, the length of the substrate 10 (direction in which the sprocket holes 10*z* are arranged) may be arbitrarily determined.

In FIG. 3A, the individual areas Care arranged in 5 lines×10 columns in the substrate 10. Alternatively, more individual areas C (e.g., several hundred columns) may be arranged by increasing the length of the substrate 10 without providing the cutting area D. Thus, after forming many individual areas C in a tape-like substrate 10, the tape-like substrate 10 can may be shipped in a state being wound as a reel.

Figure 4A:
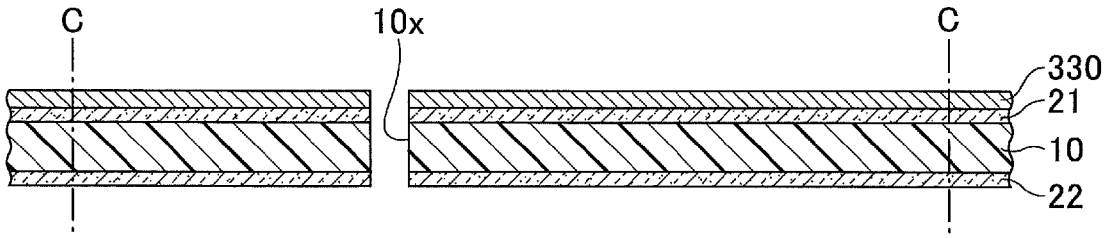
FIGS. 4A-4D are schematic diagrams illustrating processes for manufacturing a coil substrate according to an embodiment of the present invention (part 2)

Then, in the process illustrated in FIG. 4A, a via hole 10*x* penetrating the substrate 10, the adhesive layers 21, 22, and the metal foil 330 are formed. A plan-view shape of the via hole 10*x* may be, for example, a circular shape having a diameter of approximately 150 μm. The via hole 10*x* is formed by using, for example, a press-working method or a laser processing method.

Figure 4B:
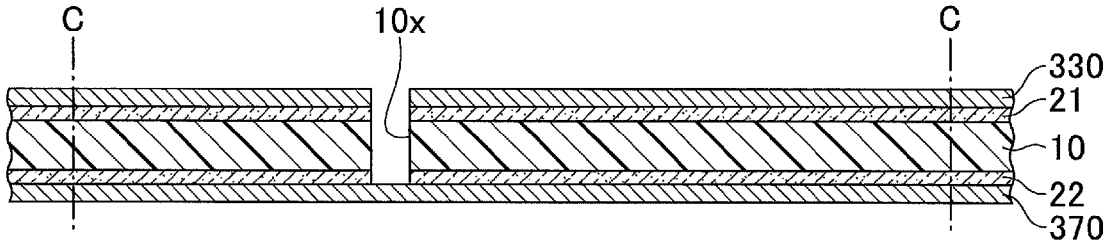

Then, in the process illustrated in FIG. 4B, a metal foil 370 is layered on the other surface of the substrate 10 interposed by the adhesive layer 22. The metal foil 370 corresponds to the parts that eventually become the third wirings 35A, 35B. The metal foil 370 may be, for example, a copper foil. The thickness of the metal foil 370 may be, for example, approximately 5 μm to 25 μm. After the layer of metal foil 370 is formed, the structural body illustrated in FIG. 4B is heated to a predetermined temperature. Thereby, the adhesive layers 21, 22 are hardened. It is to be noted that one surface of the metal foil 370 is exposed in a bottom part of the via hole 10*x*.

Figure 4C:
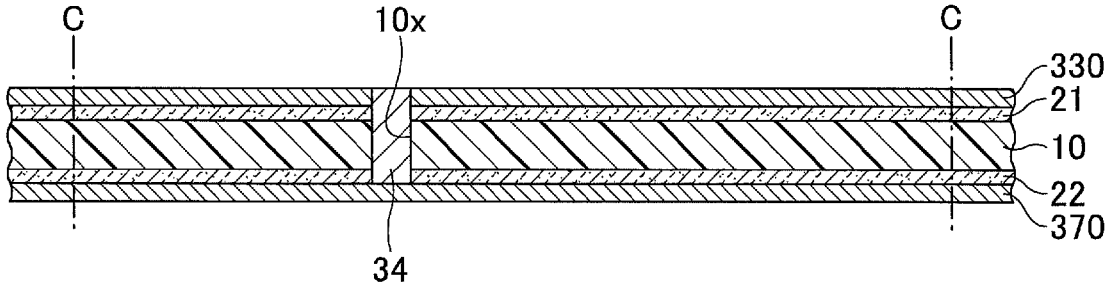

Then, in the process illustrated in FIG. 4C, the through-electrode 34 is formed by filling the via hole 10*x* with a metal material. For example, copper (Cu) may be used as the material of the through-electrode 34. The through-electrode 34 may be formed by depositing copper (Cu) by using an electroplating method from the side of the metal foil 370. Alternatively, the through-electrode 34 may be formed by filling the via hole 10*x* with a copper paste. Thereby, the metal foil 330 and the metal foil 370 are electrically connected by way of the through-electrode 34.

Figure 4D:
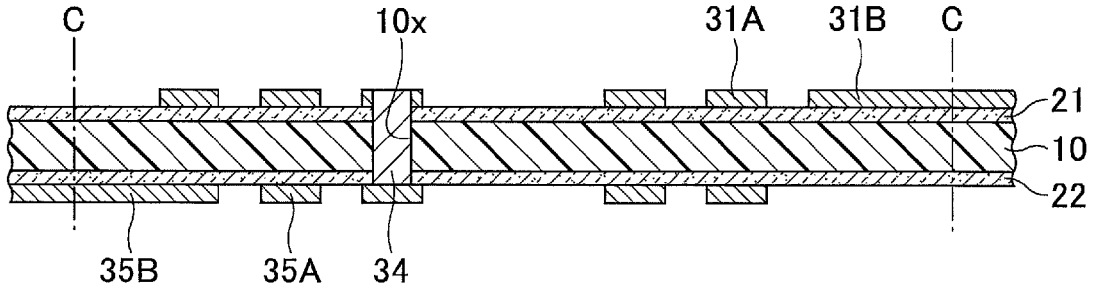

Then, in the process illustrated in FIG. 4D, the first wiring 31A, which is to become the base wiring on the one surface side of the substrate 10, is formed by patterning the metal foil 330 into a coil-like shape. The cross section of the first wiring 31A with respect to its transverse direction has a substantially rectangular shape. The first wiring 31B, which is to become a part of the connection part 33B, is formed on one end of the first wiring 31A. Similarly, the third wiring 35A, which is to become the base wiring on the other side of the substrate 10, is formed by patterning the metal foil 370 into a coil-like shape. The cross section of the third wiring 35A with respect to its transverse direction has a substantially rectangular shape. The third wiring 35B, which is to become a part of the connection part 37B, is formed on one end of the third wiring 35A.

The patterning of the metal foils 330, 370 may be performed by using, for example, a photolithography method. That is, a photosensitive resist is applied on the metal foils 330, 370, and an opening part is formed in the resist by exposing and developing a predetermined area. Then, by etching the metal foils 330, 370 exposed in the opening part, the metal foils 330, 370 are formed into a predetermined pattern. It is to be noted that the first wiring 31A and the first wiring 31B constitute a single continuous wiring. Further, the third wiring 35A and the third wiring 35B also constitute a single continuous wiring. Further, the first wiring 31A and the third wiring 35A are electrically connected to each other by way of the through-electrode 34.

Figure 5A:
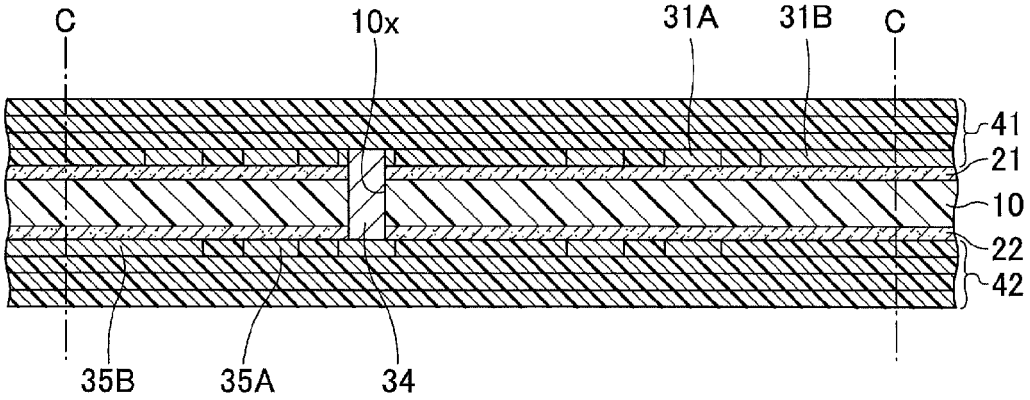
FIGS. 5A-5C are schematic diagrams illustrating processes for manufacturing a coil substrate according to an embodiment of the present invention (part 3)

Then, in the process illustrated in FIG. 5A, the permanent resist 41 that covers the first wirings 31A, 31B is layered on the adhesive layer 21 on the one surface of the substrate 10. Further, the permanent resist 42 that covers the third wirings 35A, 35B is layered on the adhesive layer 22 on the other surface of the substrate 10. The height of each of the permanent resists 41, 42 is substantially equal to or greater than the height of each of the second wiring 32A and the fourth wiring 36A that are formed in the below-described process of FIG. 6A.

For example, a single thick film of a photosensitive epoxy type resin may be used as the permanent resists 41, 42. Alternatively, as illustrated in FIG. 5A, multiple relatively thin films (e.g., each film having a thickness of approximately 50 μm) of a photosensitive epoxy type resin may be used as the permanent resists 41, 42. Alternatively, the permanent resists 41, 42 may be formed by applying a liquid or paste-like photosensitive epoxy type resin on the adhesive layers 21, 22. In this embodiment, the "permanent resist" refers to a resist that is not removed even after the resist is formed into a predetermined shape by the photolithography method (exposure and development) but remains on the final product.

Figure 5B:
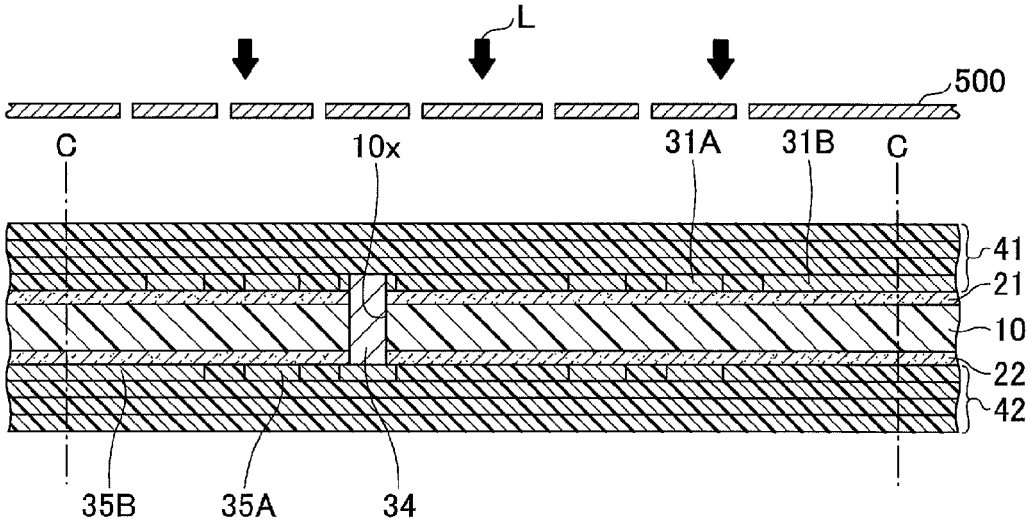

Then, in the process illustrated in FIG. 5B, the permanent resist 41 is exposed with an ultraviolet light L by way of a predetermined mask 500. Further, the permanent resist 42 is exposed with an ultraviolet light (not illustrated) by way of a predetermined mask (not illustrated). A positive type resist or a negative type resist may be used as the permanent resist 41, 42. An opening that allows ultraviolet light to pass therethrough may be formed in a predetermined area of the mask 500 or the like in correspondence with the type of resist that is used.

Figure 5C:
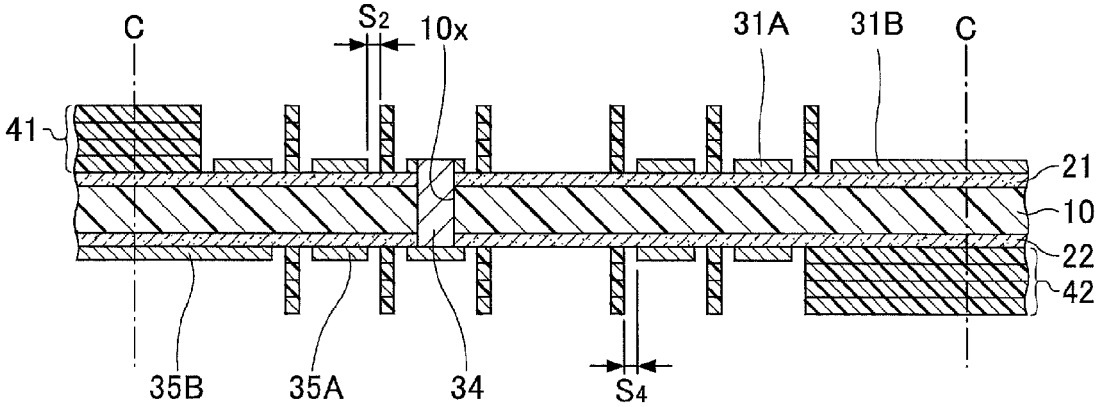

Then, in the process illustrated in FIG. 5C, the permanent resists 41, 42 are developed to remove unnecessary parts. The permanent resist 41 is formed to include the space $S_2$ between the side surface of the permanent resist 41 and the side surface of the first wiring 31A that faces the side surface of the permanent resist 41. Further, the permanent resist 41 is also formed to include the space $S_2$ between an outer part of the coil-shaped first wiring 31A and an outer part of the first wiring 31B.

Similarly, the permanent resist 42 is formed to include the space S4 between the side surface of the permanent resist 42 and the side surface of the third wiring 35A that faces the side surface of the permanent resist 42. The width of each of the spaces $S_2$, $S_4$ may be, for example, approximately 5 μm.

By removing unnecessary parts from the permanent resists 41, 42, each of the side surfaces of the permanent resists 41, 42 is substantially orthogonal to the one or the other surface of the substrate 10. As a result, in the below-described process of FIG. 6A, the wirings 33A, 37A can be formed, so that the cross section of the each of the wirings 33A, 37A with respect to its transverse direction (width direction) has a substantially rectangular shape.

Figure 6A:
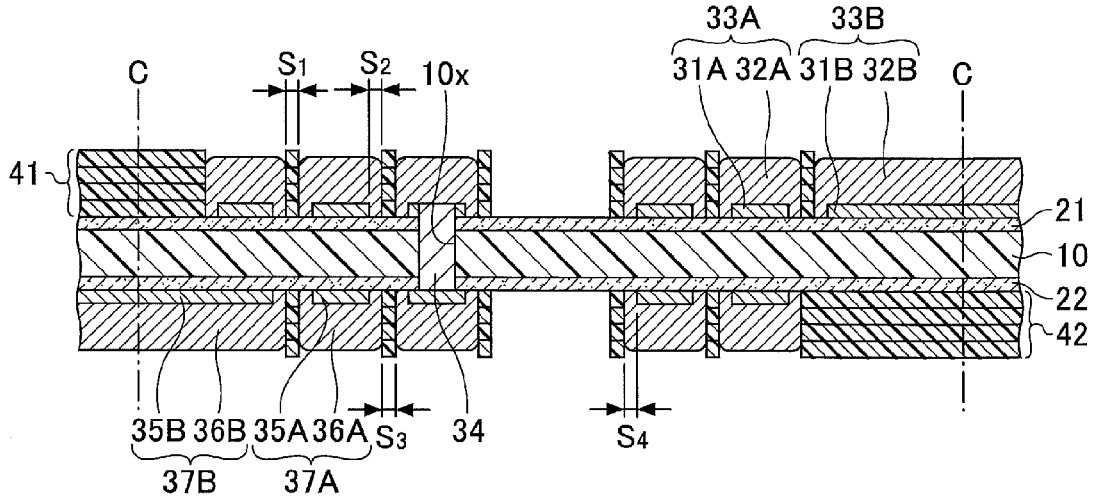
FIGS. 6A-6C are schematic diagrams illustrating processes for manufacturing a coil substrate according to an embodiment of the present invention (part 4)

Then, in the process illustrated in FIG. 6A, the second wiring 32A is formed on the one surface of the adhesive layer 21 by using, for example, an electroplating method to cover the one surface of the first wiring 31A and the side surface of the first wiring 31A. Similarly, the second wiring 32B is formed on the one surface of the adhesive layer 21 by using, for example, an electroplating method to cover the one surface of the first wiring 31B and the side surface of the first wiring 31B. In the case of using the electroplating method, the first wirings 31A, 31B may be used as power-feeding layers. For example, copper (Cu) may be used as the material of the second wirings 32A, 32B. The thickness of each of the second wirings 32A, 32B (i.e. thickness of the second wirings 32A, 32B without including the first wirings 31A, 31B) may be, for example, approximately 50 μm to 200 μm. The width of the second wiring 32A may be, for example, approximately 20 μm to 50 μm.

Thereby, the wiring 33A, which includes the first wiring 31A and the second wiring 32A covering the first wiring 31A, is formed. That is, the wiring 33A is formed into a coil shape, and the adjacent parts of the wiring 33A are divided by the permanent resist 41, so that the space $S_1$ is provided between the adjacent parts. Further, the connection part 33B, which includes the first wiring 31B and the second wiring 32B covering the first wiring 31B, is formed on one end of the wiring 33A.

Similarly, the fourth wiring 36A is formed on the other surface of the adhesive layer 22 by using, for example, an electroplating method to cover the other surface of the third wiring 35A and the side surface of the third wiring 35A. Further, the fourth wiring 36B is formed on the other surface of the adhesive layer 22 by using, for example, an electroplating method to cover the other surface of the third wiring 35B and the side surface of the third wiring 35B. In the case of using the electroplating method, the third wirings 35A, 35B may be used as power-feeding layers. For example, copper (Cu) may be used as the material of the fourth wirings 36A, 36B. The thickness of each of the fourth wirings 36A, 36B (i.e. thickness of the fourth wirings 36A, 36B without including the third wirings 35A, 35B) may be, for example, approximately 50 μm to 200 μm. The width of the fourth wiring 36A may be, for example, approximately 20 μm to 50 μm.

Thereby, the wiring 37A, which includes the third wiring 35A and the fourth wiring 36A covering the third wiring 35A, is formed. That is, the wiring 37A is formed into a coil shape, and the adjacent parts of the wiring 37A are divided by the permanent resist 42, so that the space $S_3$ is provided between the adjacent parts. Further, the connection part 37B, which includes the third wiring 35B and the fourth wiring 36B covering the third wiring 35B, is formed on one end of the wiring 37A.

Figure 6B:
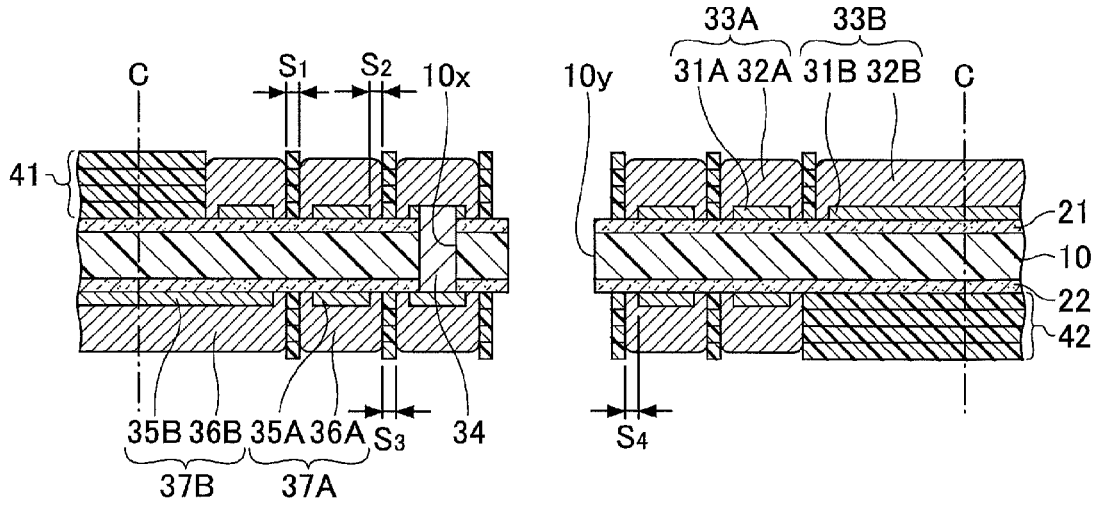

Then, in the process illustrated in FIG. 6B, the through-hole 10*y* that penetrates the substrate 10 and the adhesive layers 21, 22, is formed in an area where the wirings 33A, 37A and the connection parts 33B, 37B are not formed (i.e. a substantially center part of the substrate). The through-hole 10*y* may be formed by, for example, a press-working method.

Figure 6C:
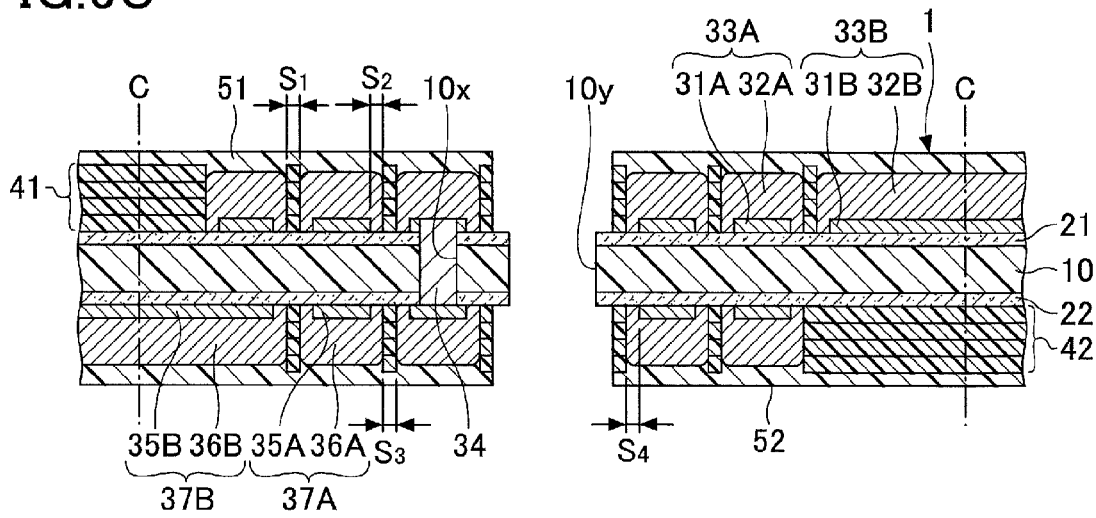

Then, in the process illustrated in FIG. 6C, the protection layer 51 is formed on the one sides of the wiring 33A, the connection part 33B, and the permanent resist 41, respectively. Further, the protection layer 52 is formed on the other sides of the wiring 37A, the connection part 37B, and the permanent resist 42, respectively. The protection layers 51, 52 may be formed by, for example, laminating a film formed of an epoxy type resin or an acrylic type resin. Alternatively, the protection layers 51, 52 may be formed by applying a liquid or paste-like resin (e.g., epoxy type resin, acrylic type resin) and curing the applied resin. The thickness of each of the protection layers 51, 52 may be, for example, approximately 5 μm to 20 μm. Thereby, the coil substrate 1 including multiple individual areas C can be formed. The order for performing the processes illustrated in FIGS. 6B and 6C may be switched.

Figure 7:
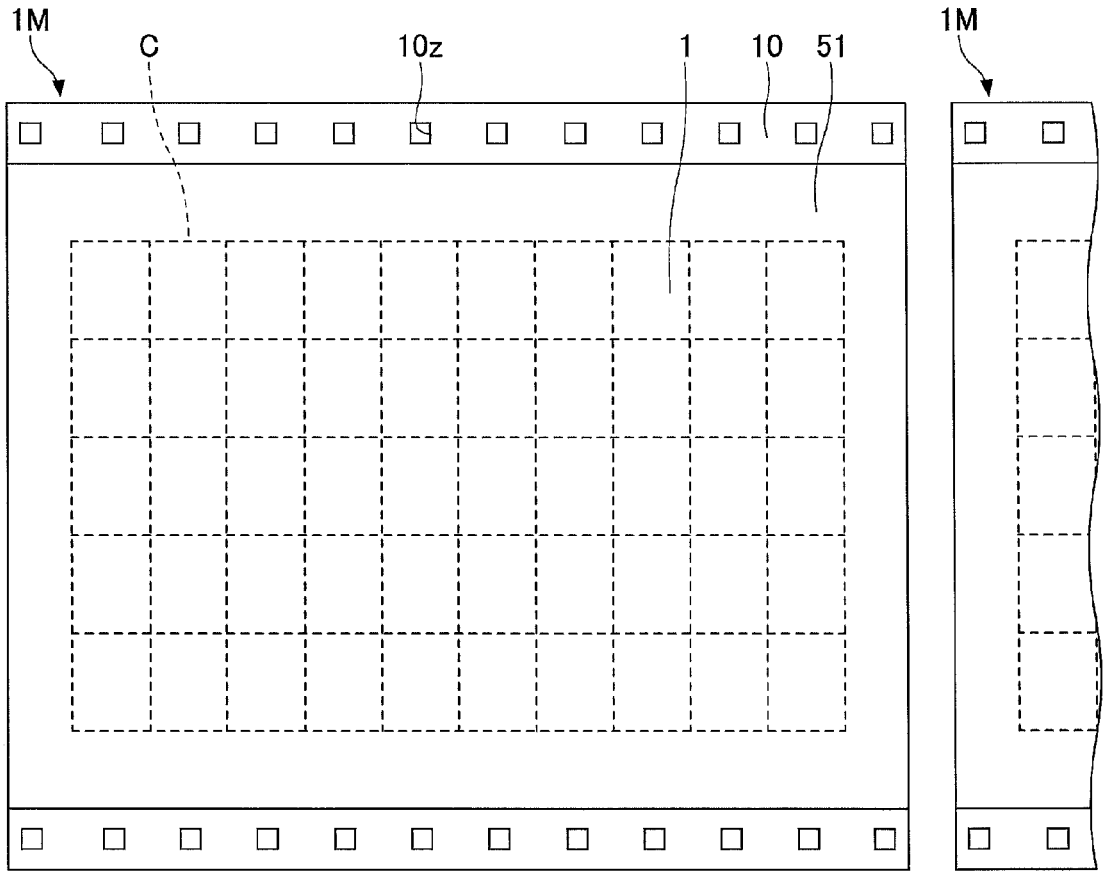
FIG. 7 is a schematic diagram illustrating processes for manufacturing a coil substrate according to an embodiment of the present invention (part 5)

In the process illustrated in FIG. 7, a tape-like or a reel-like substrate 10, which includes the coil substrate 1 having multiple individual areas C, is cut into individual pieces at the cutting area D illustrated in FIG. 3. Thereby, sheet-like coil substrates 1M are obtained. In the example of FIG. 7, 50 coil substrates 1 are included in a single coil substrate 1M. The coil substrate 1M may be shipped as a product. Alternatively, the coil substrate 1M may be further cut into individual pieces to obtain multiple coil substrates 1. Then, the coil substrates 1 can be shipped as a product. Alternatively, the process of FIG. 7 may be skipped, so that the substrate 10 can be shipped as a product in a state of a tape or a reel of tape (i.e. state illustrated in FIG. 6C).

In manufacturing the inductor 100, first, the coil substrate 1 of FIG. 1 is obtained by cutting the individual areas C of the coil substrate 1M. Thereby, the side surface of the first wiring 31B and the side surface of the second wiring 32B are exposed from the one side surface 1*a* of the coil substrate 1. Further, the side surface of the third wiring 35B and the side surface of the fourth wiring 36B are exposed from the other side surface 1*b* of the coil substrate 1.

Figure 8A:
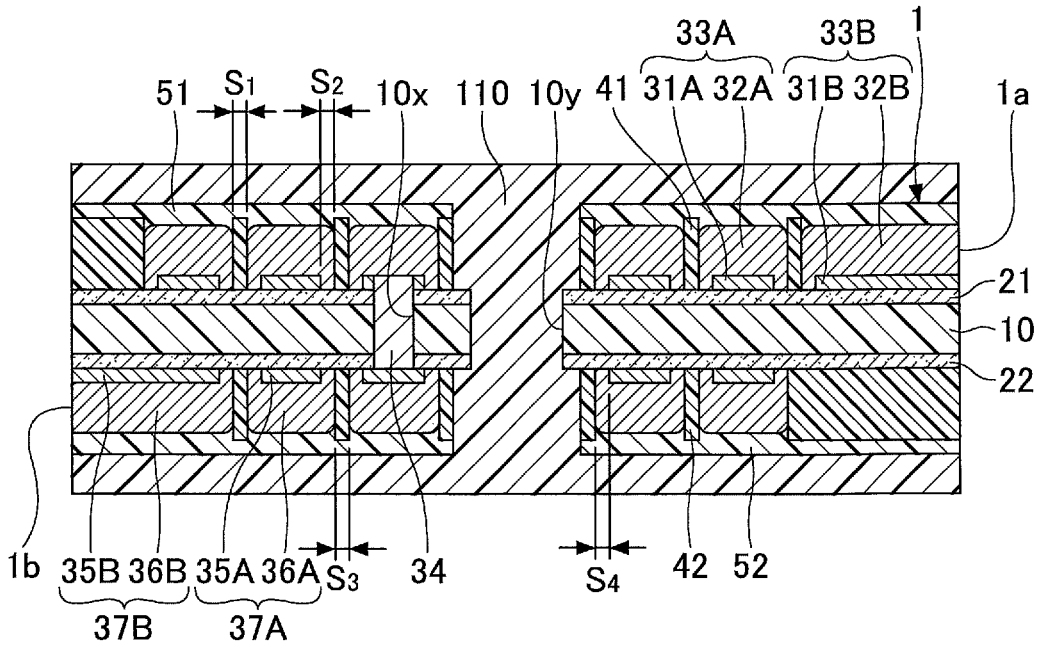
FIGS. 8A-8B are schematic diagrams illustrating processes for manufacturing an inductor according to an embodiment of the present invention.

Then, as illustrated in FIG. 8A, the encapsulating resin 110 is formed to cover the coil substrate 1 except for the one and the other side surfaces 1*a*, 1*b* of the coil substrate 1. The encapsulating resin 110 may be formed by, for example, a transfer molding method. For example, a molding resin including a filler of a magnetic material (e.g., ferrite) may be used as the encapsulating resin 110. Alternatively, the encapsulating resin 110 may be formed on the coil substrate 1M in a state illustrated in FIG. 7, so that the encapsulating resin 110 is formed on the entire individual areas C. Then, by cutting the coil substrate 1M into individual areas C, the coil substrate 1A encapsulated by the encapsulating resin 110 can be obtained as illustrated in FIG. 8A.

Figure 8B:
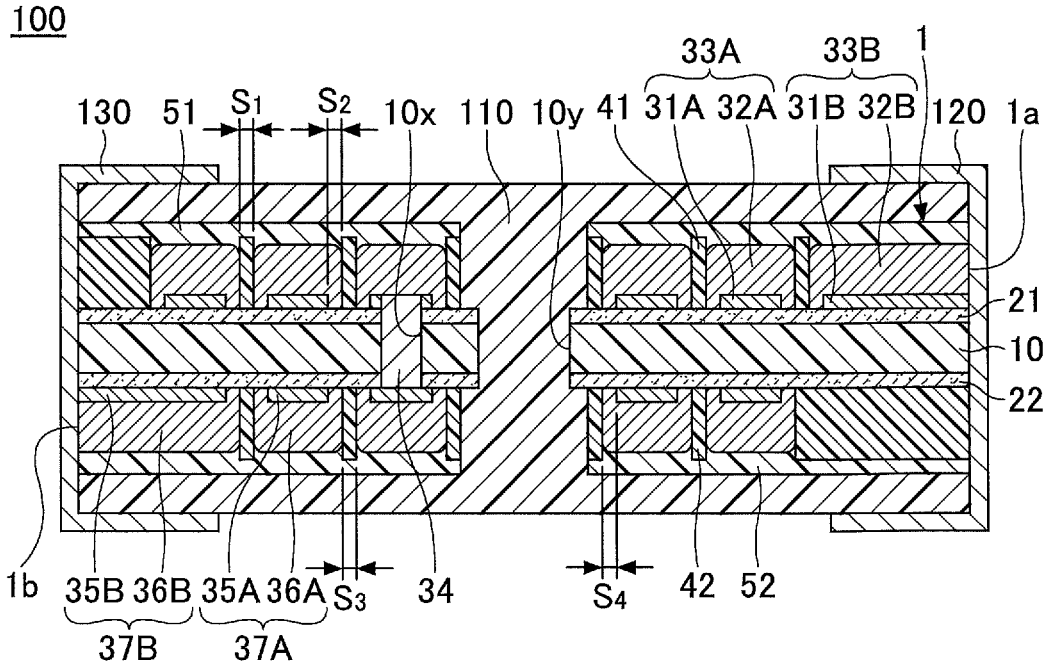

Then, as illustrated in FIG. 8B, the electrode 120 is formed continuously on the one side surface of the encapsulating resin 110, a part of the upper surface of the encapsulating resin 110, and a part of the lower surface of the encapsulating resin 110 by using, for example, a plating method or a coating method. The inner wall surface of the electrode 120 contacts the side surface of the connection part 33B exposed from the one side surface 1*a* of the coil substrate 1 (side surface of the first wiring 31B and side surface of the second wiring 32B). Thereby, the electrode 120 and the connection part 33B are electrically connected to each other. Similarly, the electrode 130 is formed continuously on the other side surface of the encapsulating resin 110, a part of the upper surface of the encapsulating resin 110, and a part of the lower surface of the encapsulating resin 110 by using, for example, a plating method or a coating method. The inner wall surface of the electrode 130 contacts the side surface of the connection part 37B exposed from the other side surface 1*b* of the coil substrate 1 (side surface of the third wiring 35B and side surface of the fourth wiring 36B). Thereby, the electrode 130 and the connection part 37B are electrically connected to each other. Accordingly, the manufacturing of the inductor 100 is completed.

Accordingly, with the coil substrate 1 according to the above-described embodiment of the present invention, the first wiring 31A is formed into a coil shape on the one surface of the substrate 10, and the permanent resist (insulating layer) 41 is formed on the one surface of the substrate, so that the space $S_2$ is provided between the sidewall of the first wiring 31A and the permanent resist 41. The permanent resist 41 is used as a dam, so that the second wiring 32A can fill the space $S_2$ and cover the first wiring 31A. Further, the second wiring 32A is formed having side surfaces that contact the permanent resist 41. Further, the second wiring 32A is formed thicker than the first wiring 31A. Thereby, the wiring 33A is formed.

Because the first wiring 31A is formed by processing a metal foil by using a photolithography method, fine-sized wirings can be formed. Further, by using the permanent resist 41 as a dam, the second wiring 32A can be thickly layered on the first wiring 31A by using an electroplating method. Thereby, even if the space between adjacent second wirings 32A is narrowed, shorting between the adjacent second wirings 32A can be prevented from occurring. Therefore, the size of the wiring 33A (e.g., plan-view size of approximately 1.6 mm×0.8 mm) can be reduced compared to the size of the conventional wiring. Thus, the number of coils (turns) of the coil-shaped wiring 33A can be increased. Further, because the second wiring 32A can be thickly formed, the cross section of the wiring 33A with respect to its width direction can be increased. Accordingly, the coil resistance (resistance of wiring 33A), which directly affects the performance of an inductor, can be reduced.

Further, by similarly forming a coil-shaped wiring 37A on the other surface of the substrate 10, the wiring 33A and the wiring 37A can be electrically connected by way of the through-electrode 34 penetrating the substrate 10. Thereby, inductance can be improved.

Further, by using an insulating resin film having a flexible property (e.g., polyimide film) as the substrate 10, the thickness of the substrate 10 can be reduced compared to a rigid substrate such as a glass epoxy substrate. Therefore, the overall thickness of the coil substrate 1 can be reduced.

In addition, by forming the substrate 10 by using a flexible insulating resin film (e.g., polyimide film) in the form of a tape or a reel of tape, the coil substrate 1 can be manufactured reel-to-reel on the substrate 10. Thus, mass production of the coil substrate 1 can be achieved. As a result, manufacturing cost of the coil substrate 1 can be reduced.

It is to be noted that, it is possible to form a coil-shaped wiring without forming the permanent resist 41, in which a predetermined space is provided between adjacent second wirings that cover the first wiring and an insulating resin is subsequently filled in the space. However, such method is unsuitable for the following reasons.

One reason is due to the difficulty of controlling the forming of the space. That is, short-circuiting of the second wiring may occur if the space is too narrow. In addition, by such method, the cross section of the wiring (first and second wirings) with respect to its width direction cannot be formed into a rectangular shape. Instead, the cross section of the wiring (first and second wirings) with respect to its width direction is formed as a drum-like (barrel-like) shape in which a diameter at a center part is larger than the diameters on upper and lower ends of the cross section. Further, the area of the cross section of the wiring in its width direction becomes inconsistent depending on the position of the wiring (first and second wirings). This causes resistance of the wiring (first and second wirings) to increase. As a result, inductance is reduced.

On the other hand, with the method according to the above-described embodiment of the present invention, the cross section of the wiring with respect to its width direction can be a rectangular shape. Thereby, resistance of the wiring (first and second wirings) can be reduced. Thus, inductance can be improved.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A coil substrate comprising:

a substrate including a first surface and a second surface on an opposite side of the first surface;

a coil-shaped wiring including a first wiring and a second wiring layered on the first wiring, the coil-shaped wiring provided on the first surface of the substrate, the coil-shaped wiring including adjacent parts provided adjacent to each other with respect to a width direction of the substrate;

another coil-shaped wiring provided on the second surface of the substrate, the another coil-shaped wiring including another adjacent parts provided adjacent to each other with respect to the width direction of the substrate;

an insulating layer formed between the adjacent parts of the coil-shaped wiring;

another insulating layer formed between the another adjacent parts of the another coil-shaped wiring; and a through-electrode that penetrates the substrate and the first wiring;

wherein the coil-shaped wiring and the another coil-shaped wiring are connected by way of the through-electrode, wherein the through-electrode includes an end surface exposed on one end of the through-electrode, wherein the second wiring covers the exposed end surface of the through-electrode and an upper surface of the first wiring, wherein a space is provided between a side surface of the first wiring and the insulating layer, wherein the second wiring fills the space and covers the first wiring, and wherein both side surfaces of the second wiring contact the insulating layer.

2. The coil substrate as claimed in claim 1, wherein a cross section of the coil-shaped wiring with respect to the width direction of the substrate has a substantially rectangular shape.

3. The coil substrate as claimed in claim 1, further comprising:

a protection layer formed on the coil-shaped wiring and the insulating layer, wherein the protection layer has an insulating property.

4. The coil substrate as claimed in claim 1, wherein the another coil-shaped wiring includes a third wiring, and a fourth wiring that is layered on the third wiring and has a thickness greater than a thickness of the third wiring, wherein another space is provided between a side surface of the third wiring and the another insulating layer, wherein the fourth wiring fills the another space and covers the third wiring, wherein both side surfaces of the fourth wiring contact the another insulating layer, wherein the first wiring and the third wiring are connected by way of the through-electrode.

5. The coil substrate as claimed in claim 1, further comprising:

a connection part that is provided on an end of the coil-shaped wiring and integrally formed with the coil-shaped wiring.

6. A coil substrate comprising:

a substrate including a plurality of areas; and the coil substrate of claim 1 formed on each of the plurality of areas.

7. The coil substrate as claimed in claim 1, wherein the second wiring has a thickness greater than a thickness of the first wiring.

8. The coil substrate as claimed in claim 4, wherein the first wiring and the third wiring are formed of metal foil, and wherein the second wiring and the fourth wiring are formed of plating.

9. The coil substrate as claimed in claim 4, further comprising a through-hole in which the through-electrode penetrating the substrate and the first wiring is formed, wherein the through-hole includes a first opening on one end of the through-hole and a second opening on the other end of the through-hole, wherein the first opening is open in the upper surface of the first wiring and the second opening is closed by the third wiring, wherein the through-electrode includes plating formed on the third wiring, and wherein the plating fills the through-hole from the first opening to the second opening.

* * * * *